United States Patent [19]

Kishimoto et al.

[11] Patent Number: 4,503,322

[45] Date of Patent: Mar. 5, 1985

[54] HEAT SENSITIVE HEATER WIRE

[75] Inventors: Yoshio Kishimoto, Osaka; Takeshi Hayashi, Nara, both of Japan

[73] Assignee: Matsushita Electric Industrial Co., Ltd., Osaka, Japan

[21] Appl. No.: 557,115

[22] Filed: Dec. 1, 1983

[51] Int. Cl.[3] ..... H05B 1/02

[52] U.S. Cl. ..... 219/505; 219/544; 219/549; 219/553; 338/22 R

[58] Field of Search ..... 219/504, 505, 528, 548, 219/541, 549, 544, 553; 338/22 R, 22 SD, 214; 156/51; 252/518

[56] References Cited

U.S. PATENT DOCUMENTS

| | | | |
|---|---|---|---|
| 3,365,618 | 1/1968 | Obenhaus | 338/22 R X |
| 3,493,727 | 2/1970 | Hosohawa et al. | 219/505 |
| 3,690,974 | 9/1972 | Kawazoe | 156/51 |
| 3,976,854 | 8/1976 | Tshikawa et al. | 219/505 |
| 4,024,427 | 5/1977 | Belhomme | 338/22 R X |
| 4,149,066 | 4/1979 | Niibe | 219/505 |

*Primary Examiner*—Volodymyr Y. Mayewsky
*Attorney, Agent, or Firm*—Burgess, Ryan & Wayne

[57] ABSTRACT

Disclosed is a heat sensitive heater wire comprising a conductor for a first electrode, an internal function layer, a conductor for a second electrode, an external function layer, a conductor for a third electrode, and an insulating housing which are formed in said order, one of the internal function layer and the external function layer comprising a heat generating layer having a self-temperature controllability, the other comprising a high-molecular temperature sensitive layer or a temperature fuse layer. If this heat sensitive heater wire is used, a surface heating device of high safety free from abnormal overheat and local overheat can be obtained.

11 Claims, 3 Drawing Figures

HEAT SENSITIVE HEATER WIRE

BACKGROUND OF THE INVENTION

I. Field of the Invention

The present invention relates to a heat sensitive heater wire used for electric heating devices such as surface heating devices.

II. Description of the Prior Art

In the past, a temperature sensor wire, a heater wire, a heat sensitive heater wire or the like used for a surface heating device is constructed as shown in FIG. 1. That is, a conductor 2 for a first electrode is spirally formed on a core thread 1, and a high-molecular weight heat sensitive layer 3, a conductor 4 for a second electrode and an insulating housing 5 are formed in said order. In case of the heater wire, at least one of the electrode conductors is used as a heat generating element wire, and the high-molecular weight heat sensitive layer is used as a temperature fuse. In case of the temperature sensor wire, it is formed into a temperature sensor which detects a change in impedance resulting from the temperature of the high-molecular heat sensitive layer. In this system, the sensor and heater are formed of separate wires, which is called a two-wire system. On the other hand, in case of the heat sensitive heater, one of the inner and outer electrodes serves as a heat generating element wire, and the other serving as a signal wire, which detects a change in impedance resulting from the temperature of the high-molecular weight heat sensitive layer and also has a function as a temperature fuse in response to abnormal rise in temperature. This system is called a single wire system.

These systems have a function for controlling temperature and a function for detecting local overheating, but their heating value per unit length is constant, and their temperature distribution varies with changes in the wiring pattern. The local overheating detecting function is insufficient, and the characteristic thereof greatly depends on the B-constant of the sensor and the wiring pattern. Moreover, the system is large in size and the local detecting function deteriorates as the heater length increases.

SUMMARY OF THE INVENTION

The present invention provides a heat sensitive heater wire which has a heat generating layer having a self-controllability for temperature and is entirely free from local overheating.

In accordance with the present invention, a conductor for a first electrode, an internal function layer, a conductor for a second electrode, an external function layer, a conductor for a third electrode and an insulating housing are formed in said order, one of the internal function layer and the external function layer comprising a heat generating layer having a self-controllability for temperature, the other comprising a high-molecular temperature sensitive layer or a temperature fuse layer.

By application of the heat sensitive heater wire constructed as described above to a surface heating device or the like, it is possible to provide a heating device which is extremely high in stability, and free from abnormal overheating.

DETAILED DESCRIPTION OF THE PREFERRED EMBODIMENT

Figure 1:
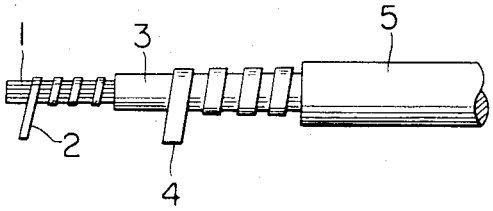
FIG. 1 PRIOR ART
FIG. 1 shows a construction of a conventional heater wire.
Figure 2:
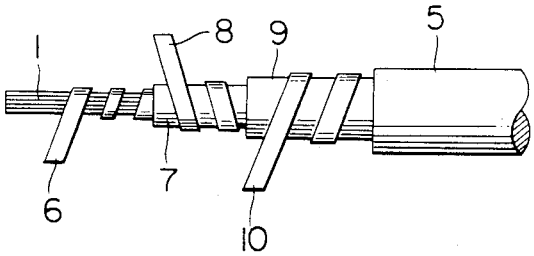
FIG. 2 shows a construction of one embodiment in accordance with the present invention.
Figure 3:
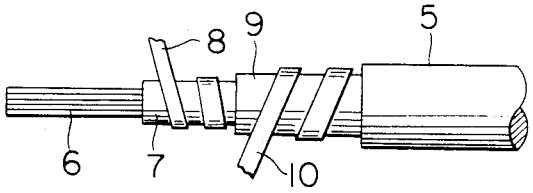
FIG. 3 shows a construction of another embodiment in accordance with the present invention.

FIG. 2 shows one embodiment of the present invention, wherein a conductor 6 for a first electrode, an internal function layer 7, a conductor 8 for a second electrode, an external function layer 9, a conductor 10 for a third electrode, and an insulating housing 5 are formed in said order on a core thread 1. One of the internal function layer 7 and external function layer 9 comprises a heat generating layer having a self-controllability for temperature, and the other comprising a high-molecular temperature sensitive layer or a temperature fuse layer. It is noted that the conductor for a first electrode can be formed so that a core thereof comprises a metal wire as in general electric wires as shown in FIG. 3, or a metal foil can be wound about the core thread as shown in FIG. 2.

The aforesaid heat generating layer can be made to have a self-temperature control function by a high-molecular composition containing a grain-like conductive agent principally with a carbon black. Specifically, a crystalline high-molecule and carbon black can be combined to form a composition of positive characteristic heat generating body having a great positive coefficient of temperature at a critical temperature of the crystalline material. For example, resins used therefor include polyethylene-vinyl acetate copolymer, polyethylene-ethyl acrylate copolymer, polyolefin such as polyethylene, polypropylene, polyamide, polyhalogenation vinylidene, polyester and the like, which exhibit a rapid positive coefficient of temperature in the vicinity of a critical temperature of crystal thereof. These high-molecules can provide a resistance stability by a chemical cross linkage or electron beam cross linkage.

Since the heat generating layer is disposed between the internal and external electrodes having a spacing therebetween of 0.3 to 0.5 mm, a composition of high specific resistance can be used, and thus, the heat generating layer may be easily given a positive coefficient of resistance variation with temperature. As a consequence, the heat generating layer may have self-temperature controllability.

On the other hand, for the high molecular weight temperature sensitive layer, high molecular weight compositions which change ion conductivity, electron conductivity or capacitance due to the temperature, which is called a plastic thermistor, and a nylon composition, polyvinyl chloride composition, composition of polyvinyl chloride-vinyl acetate copolymer or the like are generally used to produce said layer. For the temperature fuse layer, crystalline high-molecules having a melting point over the self-control temperature of the heat generating layer, for example, such as nylon composition, polyolefin can be used. Suitable for heat generating layer material having a self-control point at 60° C.–80° C. as a heater for the electric heating device are polyethylenevinyl acetate copolymer and ethylene-ethyl acrylate. In this case, a crystalline high-molecule having a melting point of 90° C.–200° C. can be used for the temperature fuse layer, and polyethylene, polyester or the like are suitable.

By designing the heat sensitive heater wire as described above, a system having a high safety as indicated in the following table can be obtained. The table indicates the safety of the temperature sensor heater system.

TABLE

| Heater | | Sensor: Without sensor | Only temp. fuse | Temp. sensor without temp. fuse | Temp. sensor with temp. fuse |
|---|---|---|---|---|---|
| Heater without temperature fuse | A | X | X | O | O |
| | B | X | X | Δ | Δ*2 |
| | C | X | O | X | O |
| Heater with temperature fuse | A | X | X | O | O |
| | B | X | X | Δ*1 | Δ |
| | C | O | O | O | OO*4 |
| Self-control heater without temperature fuse | A | X | X | O | O |
| | B | O | O | O | O |
| | C | X | O | X | O |
| Self-control heater with temperature fuse | A | X | X | O | O |
| | B | O*3 | O | O | O |
| | C | O | OO | O | OO |

In the above-described table:
A: Temperature control function: present (O), not present (X)
B: Local overheat controllability: present (O), not present (X), reliance on sensor characteristic (Δ)
C: Abnormal overheat fusability: present (O), not present (X)
*1Two-wire type temperature control system employed for electric blankets and electric carpets.
*2Single wire type temperature control system
*3Self-control type surface heat generating body
*4Heat sensitive heater wire of the present invention By use of the heat sensitive heater wire in accordance with the present invention, excellent effects as described below may be obtained.

(1) Since the sensor and heater are in an integral form, wiring is easy and no local overheating occurs.

(2) Only the portion decreased in temperature due to greatly consumed heat is heated more than other portions, thus providing energy-saving heating.

(3) Safety is so high that abnormal overheating and local overheating can be ignored.

As described above, the present invention provides a heater wire in which a high degree of safety is provided for a wide surface heating device, and the safety is not impaired by the area thereof or the length of the heater wire.

What is claimed is:

1. A heat sensitive heater wire comprising a conductor for a first electrode, an internal function layer on said first electrode, a conductor for a second electrode on said internal function layer, an external function layer on said second electrode, a conductor for a third electrode on said external function layer, and an insulating housing covering said third electrode, one of said internal function layer and said external function layer comprising a heat generating layer having self-temperature controllability, the other function layer comprising one of a high-molecular temperature sensitive layer and a temperature fuse layer, whereby a heating current may be supplied to said heat generating layer via said second electrode and one of said first and third electrodes, and a temperature control current may be supplied to said other function layer via said second electrode and the other of said first and third electrodes to enable control of local overheating.

2. A heat sensitive heater wire according to claim 1 wherein said heat generating layer comprises a carbon black contained high-molecular composition.

3. A heat sensitive heater wire according to claim 1, wherein said high-molecular temperature sensitive layer comprises a temperature sensitive member which can transduce a change in temperature to a change in impedance.

4. A heat sensitive heater wire according to claim 3, wherein said change in impedance is based on one of a change in ion conductivity, permittivity and electron conductivity.

5. A heat sensitive heater wire according to claim 3, wherein said high-molecular temperature sensitive layer comprises ion conductive polyvinyl chloride or a nylon composition.

6. A heat sensitive heater wire according to claim 1 wherein said temperature fuse layer comprises a crystalline high-molecule having a melting point above a self-control temperature of the heat generating layer.

7. A heat sensitive heater wire according to claim 1 wherein at least one of said high-molecular temperature sensitive layer and said heat generating layer has a temperature fuse property.

8. A heat sensitive heater wire according to claim 1 wherein said conductor for a first electrode is spirally formed on a core thread.

9. A heat sensitive heater wire according to claim 1 wherein said conductor for a first electrode is arranged core-wise on a central axial portion of said internal function layer.

10. A heat sensitive heater wire assembly, comprising:

an inner elongated first electrode means;

an elongated heat generating layer comprising a positive temperature coefficient material surrounding and in electrical and thermal contact with said first electrode means;

an intermediate elongated second electrode means surrounding and in electrical and thermal contact with said heat generating layer;

said first and second electrode means being adapted to supply a heating current to said heat generating layer;

an elongated temperature sensing layer comprising a high molecular weight temperature sensitive material surrounding and in electrical and thermal contact with said second electrode means;

an outer elongated third electrode means surrounding and in electrical and thermal contact with said temperature sensing layer;

said second and third electrode means being adapted to supply a temperature monitoring current to said temperature sensing layer; and an insulating housing surrounding said third electrode means, whereby any local temperature increase due to local overheating of said heat generating layer varies any current flowing through said third electrode means which current variation may be employed to control such local overheating.

11. A heat sensitive heater wire assembly, comprising:

an inner elongated first electrode means;

an elongated heat generating layer comprising a positive temperature coefficient material surrounding and in electrical and thermal contact with said first electrode means;

an intermediate elongated second electrode means surrounding and in electrical and thermal contact with said heat generating layer;

said first and second electrode means being adapted to supply a heating current to said heat generating layer;

an elongated thermally fusible layer comprising a thermally fusible material surrounding and in electrical and thermal contact with said second electrode means;

an outer elongated third electrode means surrounding and in electrical and thermal contact with said thermally fusible layer;

said second and third electrode means being adapted to supply a temperature monitoring current to said thermally fusible layer; and an insulating housing surrounding said third electrode means, whereby any local temperature increase due to local overheating of said heat generating layer results in fusing of the adjacent portion of said thermally fusible layer and a corresponding substantial change in any current flowing through said third electrode means.

* * * * *